United States Patent [19]

Blazevic

[11] Patent Number: 4,909,055

[45] Date of Patent: Mar. 20, 1990

[54] APPARATUS AND METHOD FOR DYNAMIC HIGH TENSION ROLLING IN HOT STRIP MILLS

[76] Inventor: David T. Blazevic, 201 Lake Dr. - Unit 1A, Olympia Fields, Ill. 60461

[21] Appl. No.: 217,476

[22] Filed: Jul. 11, 1988

[51] Int. Cl.[4] ..... B21B 37/02

[52] U.S. Cl. ..... 72/9; 72/12; 72/16; 72/205

[58] Field of Search ..... 72/18, 17, 16, 9, 12, 72/205

[56] References Cited

U.S. PATENT DOCUMENTS

| | | | |
|---|---|---|---|
| 3,170,344 | 2/1965 | Marrs | 72/17 |
| 3,248,916 | 5/1966 | Kenyon | 72/12 |
| 3,427,848 | 2/1969 | Gay | 72/205 |
| 4,299,103 | 11/1981 | Marten | 72/16 |
| 4,528,830 | 7/1985 | Masui et al. | 72/16 |
| 4,557,126 | 12/1985 | Niino et al. | 72/16 |

OTHER PUBLICATIONS

David T. Blazevic, "Gage Control–A New Analysis for Hot Strip Mills," Prepared for Association of Iron & Steel Engineers, Sep. 1986.

David T. Blazevic, "Information and Data on Patent Application for Dual Tension Looper Operation," prepared for Edward M. Sikina, Rouge Steel Co., Nov., 1986.

*Primary Examiner*—Daniel C. Crane

*Attorney, Agent, or Firm*—Leydig, Voit & Mayer

[57] ABSTRACT

The invention is directed to a system for controlling the gauge and width dimensions of elongated steel strips processed in the finishing stage of a hot rolling mill. Loopers located between adjacent mill stands in the finishing stage apply tension to the strips such that the tension causes plastic deformation of the strip. By providing a dynamic adjustment of the tension responsive to gauge and width sensing devices, the amount of permanent deformation in the plastic region is controlled. By controlling the amount of permanent deformation of a strip in the plastic region, the adjustable tension of the loopers effectively reduces variation of both gauge and width to an extent previously not possible. Preferably, corrections to width variation are carried out by the most upstream loopers. Corrections of gauge variations are carried out by downstream loopers and preferably by the last looper in the finishing stage.

12 Claims, 10 Drawing Sheets

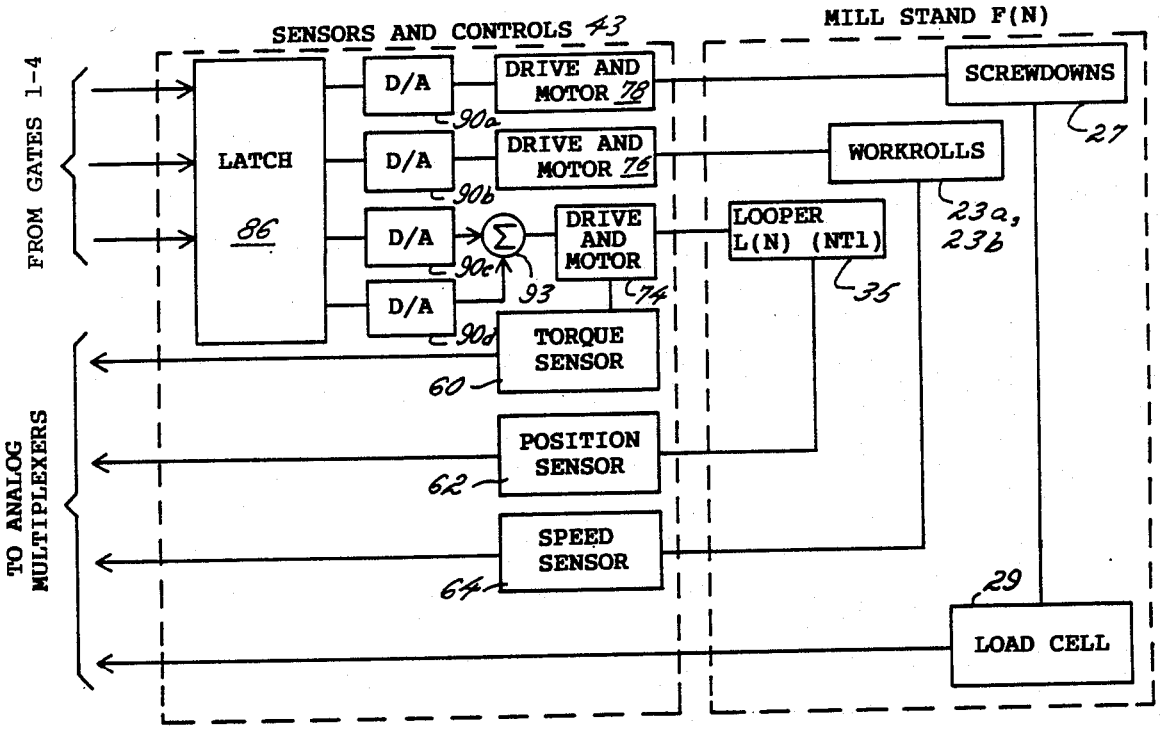
FIG. 6a
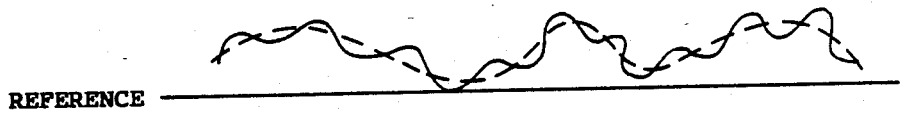
FIG. 6b
TENSION TABLE
FOR
GAUGE AND WIDTH
| | Δ TENSION | Δ GAUGE | Δ WIDTH |
|---|---|---|---|
| L6-7 | | | |
| L5-6 | | | |
| L4-5 | | | |
| L3-4 | | | |
| L2-3 | | | |
| L1-2 | | | |
FIG. 7

APPARATUS AND METHOD FOR DYNAMIC HIGH TENSION ROLLING IN HOT STRIP MILLS

TECHNICAL FIELD

This invention generally relates to hot strip mill processing of elongated steel strips and, more particularly, to an improved apparatus and method for controlling the width and gauge of the strips.

BACKGROUND OF THE INVENTION

In hot rolling mills, systems are typically provided for controlling operating variables (e.g., rolling force) in the finishing mill stage in order to produce a strip having a uniform predetermined gauge. The most common of these systems have very poor response times and are useful only to correct gauge variations having wavelengths of the same order of magnitude as the length of the strip. For the correction of gauge errors which having shorter wavelengths, very complex and expensive systems are used. Because these systems involve changes in rolling forces, they typically have poor response times and do not satisfactorily correct gauge variations of short wavelengths.

In a conventional rolling mill, looper rolls are positioned between adjacent mill stands in the finishing mill stage. These rolls are conventional devices which maintain tension in the section of the strip between the adjacent mill stands in order to hold the strips along the center line of the mill. The looper rolls are set to apply the greatest amount of tension without causing the strip to yield.

The looper rolls also ensure that the mass flow out of a mill stand equals the mass flow into the adjacent downstream mill stand. When more mass is flowing out of the upstream mill stand than is flowing into the downstream stand, the strip will become slack and the looper roll will change position in an attempt to maintain tension In response to this change of position, the speed of one or both of the adjacent mill stands is changed in order to equalize the mass flow and return the looper roll to its original position. A similar adjustment is made when tension becomes too high from unequal mass flow.

In a recent attempt to reduce the well-known effect of width "neckdown" when strips are threaded into the finishing mill stage, the tension on the strips from looper rolls has been increased beyond the strip's yield point. Immediately after a strip is threaded or between stands, the associated looper roll applies only normal tension in order to minimize the "neckdown" effect. Thereafter, the tension is raised in order to cause the strip to yield so that both gauge and width are reduced. The results are strips characterized by more uniform gauge and width than previously possible. In this system, the high tension is set at a predetermined level which remains constant.

Although the foregoing system of high tension rolling provides more uniform gauge and width dimensions and thereby provides an inexpensive system to reduce the magnitude of relatively short wavelength variations of gauge, it has no ability to adjust to dynamic changes in the system which cause gradual changes in gauge and width when the strip is considered as a whole. Sometimes the drifting of the gauge and width dimensions results in substantial differences when various areas of a strip are compared. These differences can result in strips being scraped because areas of it are beyond the customer's specified tolerances.

SUMMARY OF THE INVENTION

In view of the foregoing, it is a general object of the invention to provide an improved apparatus and method for high tension rolling in a hot rolling mill which eliminates the drifting of gauge and width dimensions.

It is a further object of the invention to provide width adjustment for strips as they are processed in the finishing stage of a hot rolling mill. To the best of applicant's knowledge, width adjustment in the finishing stage was previously unknown.

It is a further object of the invention to provide the foregoing improved performance using existing mechanical rolling equipment in the finishing stage, thereby providing an easy retrofit of the invention to existing mills.

It is yet another object of the invention to eliminate the drifting of gauge and width dimensions during high tension rolling using relative inexpensive retrofits.

Still another object of the invention is to further improve the reduction of short and medium wavelength gauge variations provided by static high tension rolling.

Other objects and advantages of the invention will become apparent from reading the following detailed description and upon reference to the drawings.

In keeping with the foregoing objects, an apparatus and method of the invention utilizes "high tension" rolling for approximating monotonic gauge and width dimensions as measured along the length of elongated steel strips formed by a hot rolling mill. High tension rolling as the phrase is used herein is intended to be conventional hot rolling of strips supplemented by the presence of sufficient tension on the strip areas between adjacent mill stands in a finishing mill so as to cause the plastic region of the strip between the nips of the work rolls to extend both upstream and downstream. By first intentionally causing plastic deformation of the strips through the application of tension and then dynamically adjusting the tension in response to gauge and width variations, improved dimensional uniformity results. Furthermore, because plastic deformation affects both gauge and width, adjustments of tension according to the invention are segregated into adjustments responsive to width or gauge variations so that each dimension may be controlled virtually independently of the other.

BRIEF DESCRIPTION OF THE DRAWINGS

FIG. 6*a* is a detailed block diagram of the controls and sensors unit at each mill stand and adjacent looper in FIG. 1;

FIG. 6*b* is an illustrative waveform for a torque adjustment signal to a torque motor for a looper according to the invention, where the waveform incorporates torque adjustments for both long and short wavelength variations in the gauge of a strip;

FIG. 7 is a schematic representation of a data look-up table stored in memory by the control system of FIG. 5 for use in determining the necessary command to execute a gauge and/or width adjustment;

Figure 1:
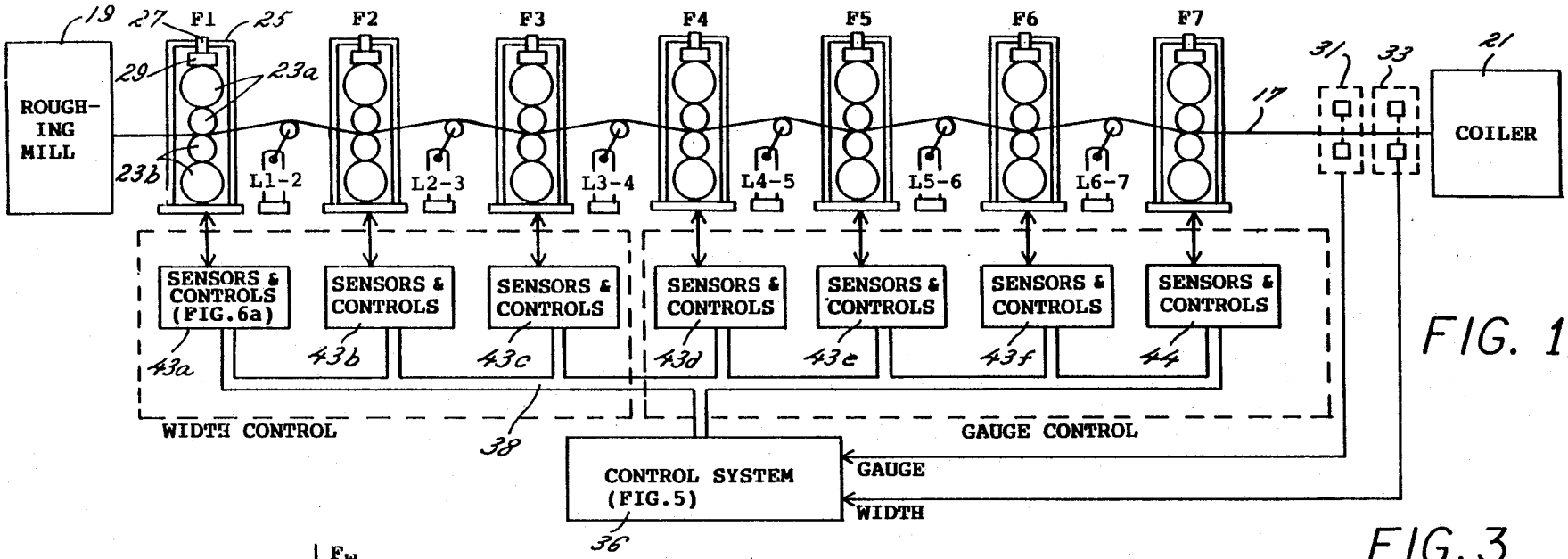
FIG. 1 is a schematic diagram of an exemplary hot rolling mill incorporating a control system according to the invention with the mill stands in the finishing stage individually illustrated in order to show how width and gauge variations of the elongated steel strips are controlled by different groups of mill stands.

While the invention will be described in connection with a preferred embodiment, it will be understood that the following description is not intended to limit the invention to a particular embodiment. On the contrary, it is applicant's intention to cover all alternatives and equivalents as may be included within the spirit and scope of the invention.

DETAILED DESCRIPTION OF THE PREFERRED EMBODIMENT

Turning to the drawings and referring first to FIGS. 1–4, a seven-stand tandem finishing mill 15 in an exemplary hot rolling mill receives an elongated steel strip 17 from a roughing mill 19. The steel strip 17 is threaded through the seven mill stands F1–F7 of the finishing mill 15 and enters a coiler 21 of conventional design. Although the illustrated finishing mill 15 incorporates seven mill stands F1–F7, it will be appreciated by those skilled in the design of hot rolling mills that the number of mill stands typically vary from four to seven, depending on a mill's design requirements.

As is well known, each mill stand F(N)), where N equals one through seven, includes two pairs of opposing work rolls 23*a* and 23*b*, supported in a frame 25, a screwdown 27 for adjusting the position of the work rolls and a load cell 29 to sense the rolling force imparted to the strips at the nip of the work rolls. A gauge sensor 31 is typically positioned after the last mill stand F7 in order to provide a sensing signal for any gauge control system utilized by the mill. Although width control is not possible on conventional systems, a width sensor 33 may also be found with the gauge sensor 31. Usually, the width sensor 33 serves as a quality control information source, ensuring coils meet a customer's specification.

As previously mentioned, it is known to be important to maintain an equal mass flow throughout the finishing mill. In other words, the mass flow through each of the mill stands must be equal to the mass flows through the other mill stands. Unequal mass flow will result in either the strip gathering or stretching between adjacent mill stands. In order to sense any such gathering or stretching of the strip, an in-line device for setting the tension on the strip between adjacent mill stands is typically provided. These devices are known as looper rolls or simply loopers, and they are positioned to contact the strip at approximately half way between adjacent mill stands, as shown in FIG. 1. As illustrated, each looper is identified by the letter "L" followed by the numbers of the mill stands it is located between. For example, the looper between mill stands F4 and F5 is identified as looper L4-5.

It will be appreciated by those skilled in the art of hot rolling mills that virtually all modern mills are equipped with mass flow control systems. Changes in mass flow between adjacent mill stands F(N)) and F(N+1)) cause changes in the tension of the strip area spanning the adjacent mill stands. The change in the tension is primarily seen as a change in position at one or more of the loopers F(N), N+1). To maintain equal mass flow through the finishing mill the conventional system for controlling the mass flow rate responds to a change in looper position by first adjusting the speed and then the rolling force of the work rolls for various ones of the mill stands in order to equalize the mass flow at each mill stand. This conventional system attempts to maintain the angular position of each looper F(N), N+1) at a predetermined value. As will become clear from the following description, the tension control system of the invention complements and does not interfere with the existing control system for equalizing mass flow in that mass flow disturbances caused by changes in the tension applied by a looper F(N), N+1) are compensated for by the mass flow control system.

Figure 3:
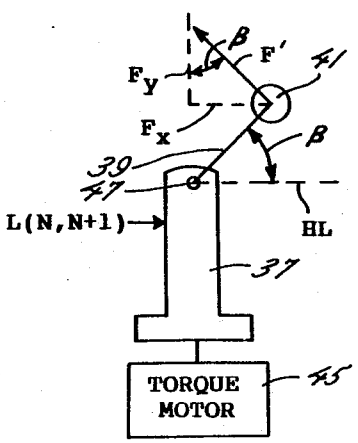
FIG. 3 is an isolated view of one of a plurality of looper rolls positioned between adjacent mill stands in FIG. 1 for use in applying tension to the steel strips by way of a rotational force or torque F.

The loopers in FIG. 1 are of conventional design and include a base 37 as best seen in FIG. 3, each supporting an arm 39 for rotation about an axis transverse to the direction of strip movement. At the end of the arm is a roller 41 for contacting the underside of the elongated steel strip. Torque is applied to the arm 39 and roller 41 via a control device (e.g., electric, pneumatic or hydraulic) in one of the sensors-and-controls units 43*a–f* and a linkage (not shown) coupled to the rotational axis of the arm. Sensors in the sensors-and-controls units 43*a–f* include a sensor for indicating the angular position of the associate looper arm 39. As explained more fully hereinafter, the illustrated embodiment utilizes electrical controls in the sensors-and-controls units 43; however, it will be appreciated the pneumatic or hydraulic controls are well-known equivalents.

In the illustrated embodiment, a control system block 36 is connected to the sensors-and-controls units 43*a–f* in a conventional manner via a bidirectional data and control bus line 38. Variations in gauge and width of the strips 17 are sensed by the control system 36 by the gauge and width sensors 31 and 33, respectively. In addition, to controlling the gauge and width dimensions in accordance with the invention, the control system 36 is also intended to incorporate conventional control systems of the finishing mill such as the mass flow control system. In this regard, a sensors-and-controls 44 is illustrated in connection with the last mill stand F7. Although there is no looper downstream from the mill stand F7 to be controlled in accordance with the invention as explained hereinafter, the sensors-and-controls unit 44 provides part of the conventional control system which complements the high tension control of the invention.

When a new strip 17 is threaded into the finishing mill 15, the looper arms 39 are down in order to allow the head end of the strip to enter the downstream mill stands without interference. As soon as the head end has entered a downstream mill stand F(N)), the adjacent upstream looper arm 39 is energized by a predetermined torque which raises the roller 41 into contact with the underside of the strip, resulting in some amount of tension along the length of the strip.

Figure 2:
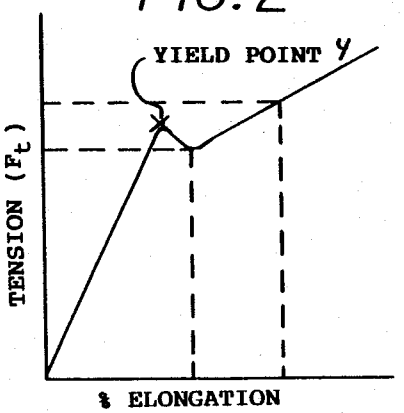
FIG. 2 is an exemplary stress/strain graph for the elongated steel strips processed by the hot rolling mill of FIG. 1, indicating an area above the yield point of the strips used to control the width and gauge of the strips in accordance with the invention.

Referring to FIG. 2, the tension along the length of the strip in conventional systems remains below the yield point Y in order to ensure the strip is not permanently deformed. In a static system with tension applied to the strip 17 by each looper L (N, N+1), the angular position of the looper arm 39 remains unchanged. If the mass flow changes, the tension will change and therefore, so does the angular position of the looper arm 39. By sensing a change in the position of the looper arm 39, conventional systems change the speed of the work rolls 23*a*, 23*b* in order to correct the mass flow inequality.

Figure 4A:
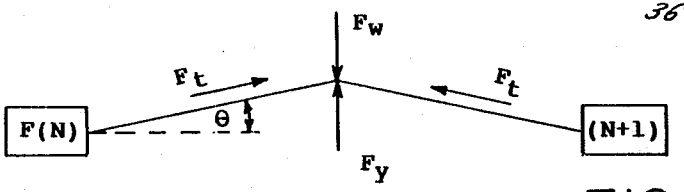
FIG. 4*a* is a force diagram illustrating how the vertical component Fy of the torque F from a looper roll interacts with the force $F_w$ of the weight of the strip between mill stands to provide the tension forces $F_t$.
Figure 4B:
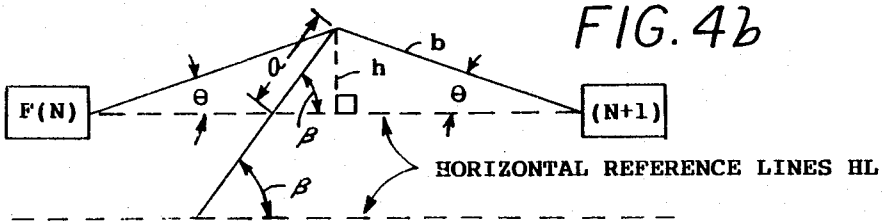
FIG. 4*b* is a trigonometric diagram intended to illustrate how the position and torque of a looper arm affect the magnitude of the vertical component $F_y$ of the torque F.

To understand the relationship between the torque and position of the looper arm 39 and the tension on the portion of a strip 17 between adjacent mill stands F(N)) and F(N+1)), reference is made to the illustrations of FIGS. 3 and 4. In the illustrated embodiment, a torque motor 45 of the sensors and controls unit 43 is coupled via a linkage (not shown) to a drive shaft 47 for rotating the looper arm 39. A resulting torque F appears at the roller 41. As will be readily apparent to those familiar with simple mechanics, in a Cartesian coordinate system, the vertical or Y- coordinate component of the torque, $F_y$, provides the tension to the strip. As a function of the torque F, the vertical component may be expressed as, $$F_y = F \cos \beta \tag{1}$$

where the angle $\beta$ is the angular rotation of the arm 39 referenced to the parallel and horizontal line HL as indicated in FIG. 3.

To determine the relationship between the vertical component $F_y$ of the torque F on the tension $F_t$, the force diagram of FIG. 4 indicates, $$F_y = F_w + F_t \sin \theta, \tag{2}$$

where $F_w$ is the weight of the strip and the angle $\theta$ is an angle referenced from the top horizontal line HL and formed by the two sides of the strip as it is raised by the force $F_y$. (The angle $\theta$ and tension $F_t$ on either side of the force $F_y$ are equal to the opposing angle $\theta$ and tension $F_t$ if the force $F_y$ is assumed to be applied in the center of the strip between two mill stands. For purpose of illustration, this assumption is made herein).

Substituting equation (1) into equation (2) and rearranging equation (2) to solve for $F_t$ gives the following:

$$F_t = \frac{F \cos \beta - F_w}{\sin \theta} \tag{3}$$

From the geometric relationship between the angles $\theta$ and $\beta$ illustrated in FIG. 4*a*, it can be seen that the angles $\theta$ and $\beta$ form two of the angles in the same triangle. From this, the following relationship may be made, $$\frac{a}{\sin \theta} = \frac{b}{\sin \beta,} \tag{4}$$

where b is the length of the strip extending from the looper roller to the mill F(N+1)) and a is the length of the looper arm extending above a horizontal reference line which approximately corresponds to the plane of the support table between the two mills F(N)) and F(N+1)). Solving for sin $\theta$, equation (4) becomes $$\sin \theta = \frac{b}{a} \sin \beta \tag{5}$$

Substituting equation (5) into equation (3) gives $$F_t = \frac{F \cos \beta - F_w}{\frac{b}{a} \sin \beta} \tag{6}$$

It can be seen from equation (6) that the tension $F_t$ on the area of the strip 17 between adjacent mill stands F(N)) and F(N+1)) can be considered as a function of the torque F applied to the arm 39 of the looper L (N, N+1) and the angle $\beta$ of the arm. To change tension $F_t$, either or both the torque F and the position angle B of the looper arm may be changed. Specifically, to raise tension, either the magnitude of the torque F may be increased or the angle $\beta$ of the looper arm may be decreased, thus increasing the vertical component $F_y$ of the torque F. Conversely, to lower tension, either the magnitude of the torque F may be decreased or the angle $\beta$ of the looper increased.

Recently, an attempt has been made to set the torque F of the looper arm 39 above the yield point Y, thereby imparting permanent width and gauge reduction to the strip. As previously indicated, such "high tension" rolling substantially reduces gauge and width variations over short distances. Skid marks for the reheating furnace are examples of the type of short wavelength variations that may be substantially reduced. By way of explanation, gauge and width variations may be divided into variations of long and short wavelengths. Variations of long wavelengths may approximate or even exceed the length of the strip 17. In this regard, the gauge or width measurement may appear to drift away from a reference value when measured from one end of the strip to the other end. By merely increasing the torque applied to the looper arm 39 so that plastic deformation occurs outside of the nip between work rolls 23a, 23b, improvement in gauge and width uniformity may be seen in that variations of short wavelengths are substantially reduced. However, such "high tension" rolling fails to significantly reduce the variations characterized by longer wavelengths and in fact may accentuate them.

The reason high tension rolling reduces short wavelength variations is because of the sudden mass flow changes associated with gauge variations of short wavelengths. The tension level set by a looper L (N, N+1) is greatly increased whenever the temperature of the strip becomes colder. The strip becomes colder at each skid mark, and there is also a temperature gradient from head end to tail end as seen by each mill stand position. As short wavelength variations such as skid marks enter a mill stand, they stretch the mill open a few thousandths of an inch. This stretching allows the rate of mass flow through the mill to increase. A sudden increase in mass flow disturbs the balance of flow and significantly increases the tension immediately upstream from and adjacent to the nip of the mill's work rolls. This increased tension pulls out the gauge variation. Normally the foregoing change of tension occurs in an elastic region and the gauge variation remains. With high tension rolling, the tension change takes place in a plastic region and the resulting change in gauge is permanent. For the longer wavelength variations that occur over several lengths of mill stands (e.g., the head-to-tail end temperature gradient), the unregulated high tension rolling is uneffective and in fact may cause both the gauge and width to be pulled negative toward the end of the strip.

According to one important aspect of the invention, tension above the yield point of the elongated steel strips is applied by the looper rollers and dynamically adjusted as the strip is processed in the finishing stage of the mill so as to substantially reduce the gauge and width variations of both longer and shorter wavelengths. The relative locations of the mills where tension adjustments occur in response to detection of width or gauge variations is important for proper operation of the invention. To adjust the width dimension, the tensions in the upstream mill stands in the finishing mill are controlled. For the gauge dimension, the next to last mill stand provides the primary control while adjacent upstream mills serve as backups.

Those skilled in the art of hot rolling mills will appreciate that whenever tension is added, there is both a gauge and width reduction of the strip. However, when tension is added to the strip between two of the upstream mill stands, the gauge reduction is virtually unnoticeable when the strip leaves the last mill stand. Therefore, high tension width control is preferably performed at the first few mill stands—e.g., F1 through F3 in the illustrated embodiment. As for gauge control using high tension, the effect on strip width is the least when the thickness-to-width ratio is the smallest. Therefore, high tension gauge control utilizes the downstream loopers L4-5, L5-6 and L6-7. In the illustrated embodiment, looper L6-7 has primary control, with loopers stands L4-5 and L5-6 serving as backups.

Another important factor in determining how gauge and width adjustments should be executed using control of high tension is the relative location of the yielding of the strip 17 between two adjacent mill stands F(N)) and F(N+1)). Plastic elongation of a strip occurs in the nip of a work roll during normal rolling conditions. During high tension rolling, the zone of plastic elongation extends out from the nip, both upstream and downstream. Empirical studies have indicated that the slight actual difference of the angles e shown in FIG. 4 between adjacent mills causes most of the plastic elongation resulting from high tension to occur at the entry of the downstream mill stand F(N+1)).

Accordingly, the plastic deformation from changes to the tension applied by the looper L6-7 between mill stands F6 and F7 occurs primarily at the entry to mill stand F7, the last mill stand in the finishing mill 15. Since correction of the gauge by high tension occurs primarily at the last mill stand F7, high tension gauge control provides a relatively quick response to variations detected by the gauge sensor 31. In contrast to the response time for gauge control, width control is relatively slow since an error detected by the width sensor 33 is responded to by the loopers L1-2, L2-3 and L3-4 between the first three mill stands F1-F3. Therefore, there is a delay before the width sensor 33 sees the effects of a correction. The fast response time of gauge control relative to width control is important because gauge is typically controlled to an approximate tolerance of ±0.002 inches, whereas width may have a tolerance of +0.1 to +0.5 inches—several hundreds of times as great.

In order to avoid the introduction of short wavelength gauge variations by a too fast response time to the gauge sensor 31, the system of the invention gradually adjusts looper tension when correcting a variation in gauge as sensed by the gauge sensor 31. In this manner, the variation stays characterized as a long wavelength variation and does not introduce a short wavelength variation where none previously existed. In this connection, the slower response time for high-tension correction of variations of longer wavelengths allows the conventional mass control system to complement the correction and maintain constant mass flow, thereby ensuring stable processing of the strips along their entire lengths.

To further reduce variation in gauge characterized by short or medium wavelengths, the high tension gauge control system of the invention includes a portion responsive to the load cells 29 of selected ones of the mill stands F(N)). The load cell portion of the gauge control system is referenced to constant rolling forces for each mill stand F(N)) upstream of the last mill stand F7. Upon detection of a change in rolling force at a particular mill stand F(N)), the gauge control system adjusts the tension on the strip provided by the adjacent and downstream looper F(N), N+1). As explained more fully hereinafter, either the torque or position of the looper L (N, N+1) is changed in response to a change in rolling force at the mill stand F(N)). Because the actual gauge adjustment occurs primarily at the downstream mill stand F(N+1)), a delay in implementing the tension correction ensures the correction occurs at the desired area of the strip.

In response to short to medium length wavelengths of gauge variation sensed at mill stand F(N)) by the load cell portion of the gauge control system, a tension adjustment is made at a time when the variation is in the plastic zone associated with the nip of the downstream mill stand F(N+1)), thereby ensuring the gauge variation is the area of the strip effected by the change in looper tension. As previously indicated, variations of short wavelengths occur and dissipate at each load cell too quickly for the mass flow control system to react. The change in mass flow brought about by variations of shorter wavelengths causes tension changes in a static high tension system which tends to reduced these variations. A dynamic high tension system provided by the load cell system of the invention further reduces these short wavelength variations. Tension adjustments are made in response to short wavelength variations at a rate which is too quick for the mass control system. Therefore, the natural change in tension caused by the mass flow inequalities are complemented by the tension changes caused by the load cells 29. Thus, the variations of short wavelengths are reduced to a greater extent than previously possible using only static high tension rolling.

For medium wavelength variations, the mass flow system has some effect and the tension changes in a static high tension system caused by mass flow inequalities are somewhat mitigated; however, they still occur and are effective in reducing these medium wavelength variations. The load cell system of the invention further reduces these shorter and medium wavelength variations by increasing the change in tension which naturally occurs in response to a short or medium wavelength gauge variation. To adequately complement this natural reduction of gauge variation which occurs at high tension, the response time of the load cell system is made very quick. Therefore, the mass flow control system does not have time to react.

Because the load cell control can be in conflict with the gauge sensor control, the load cell control is contemplated as only responsive to gauge variations of short or medium wavelengths. The possible conflict arises because a change in tension at a looper affects mass flow. A change in the mass flow at a particular mill stand F(N)), however, results in a detected change in the rolling force of the mill. Since the load cell portion of the gauge control system wants to maintain constant rolling forces, it provides commands to the loopers which may tend to negate the commands from the gauge sensor 31. In the illustrated embodiment, the potential conflict arises at loopers L4-5, L5-6 and L6-7. Upstream looper L1-2, L2-3 and L3-4, are not responsive to the gauge sensor 31 and, therefore, do not present the same conflict problem. These upstream loopers are responsive to the width sensor 33 whose width error signals are independent of gauge variation.

Because the typical tolerance for the width dimension of a strip is significantly greater than the tolerance usually associated with the gauge dimension, the high tension width control applied by loopers L1-2, L2-3 and L3-4 in response to the width sensor 33 need not be as complex as the high tension gauge control. For high tension width control, an error correction is preferably divided equally among the three loopers L1-2, L2-3 and L3-4. In this regard, the illustrated high tension control system of the invention provides width control for only longer wavelengths. Width control responsive to shorter and medium wavelengths may be accomplished with the addition of width sensors between mill stands. For example, for the upstream loopers L1-2, L2-3 and L3-4, the load-cell based control system may be modified to be responsive to width sensors. As a result, tension adjustments at the loopers L1-2, L2-3 and L3-4 would be responsive to width variations of both shorter and longer wavelengths.

In order to prevent changes in high tension at the width control loopers L1-2, L2-3 and L3-4 from affecting the final gauge of the strips, an empirically determined maximum tension is identified for each looper L1-2, L2-3 and L3-4. For the width control system, this maximum tension is translated into a torque and looper arm position limit for each looper. Because looper L1-2 is the most upstream of the three width control loopers and the strip at that point has its greatest gauge-to-width ratio, the largest amount of tension can be applied by the looper L1-2 without affecting the final gauge dimension of the strip when it leaves mill stand F7. Because loopers L2-3 and L3-4 are farther downstream and the gauge-to-width ratio is reduced, a lesser maximum tension may be applied.

Figure 5:
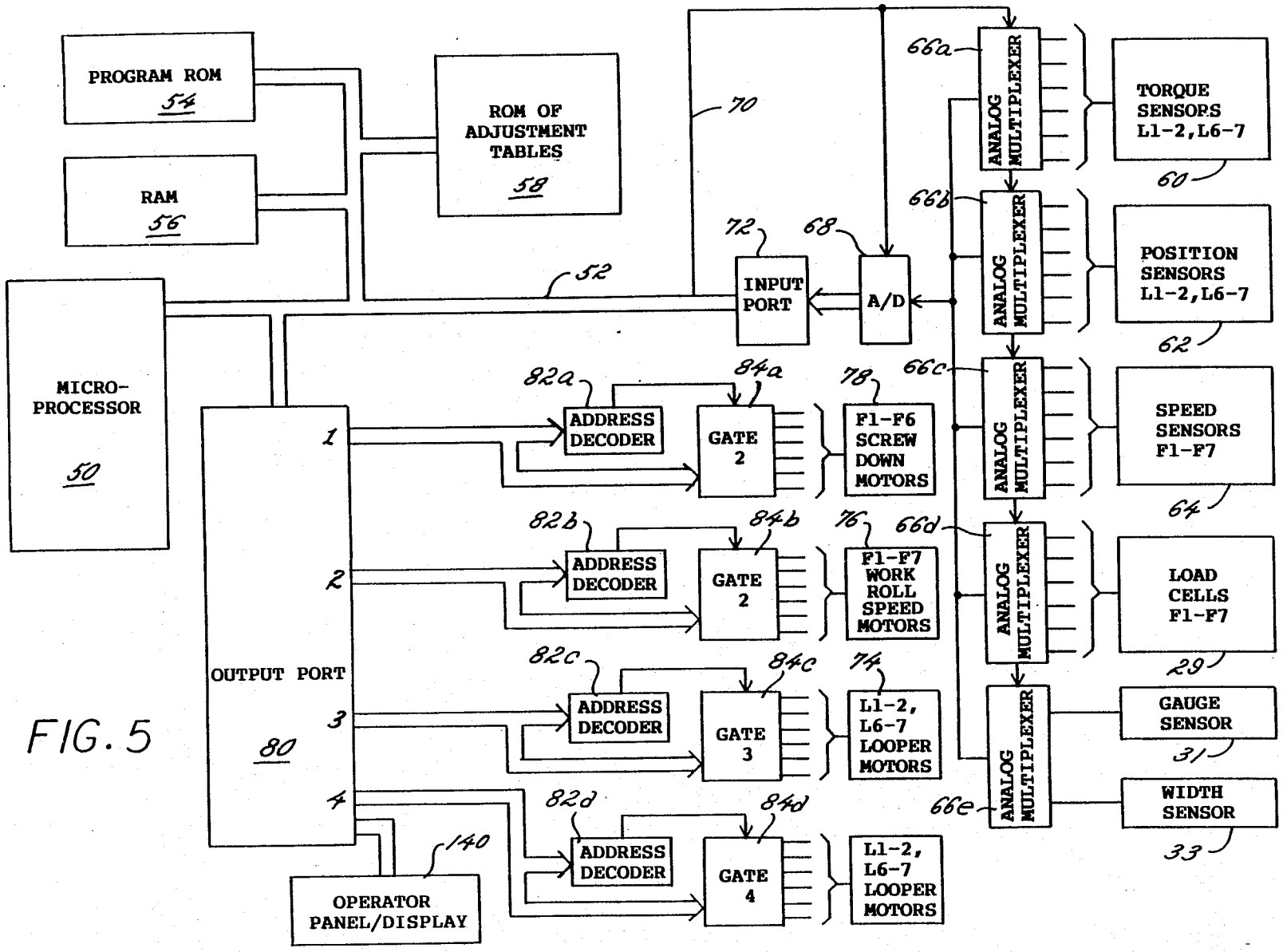
FIG. 5 is a detailed block diagram of the control system in FIG. 1.

To accomplish a high tension control system in accordance with the invention, the control system 36 of FIG. 1 is a microprocessor based system as indicated by the exemplary embodiment in FIG. 5. To carry out the invention, a microprocessor 50 in FIG. 5 executes gauge, width, and load-cell tension adjustment routines and subroutines flowcharted in FIGS. 9–13. In a conventional manner, a data and control bus 52 connects the microprocessor 50 to a program ROM 54, containing the routines in a machine-readable form. In a well-known manner, a RAM 56 serves as a scratch-pad memory. A second RAM 58 contains tension adjustment tables shown in FIG. 7. As will be explained in greater detail in connection with FIG. 7, the microprocessor 50 responds to the gauge sensor 31 by first determining what amount of tension adjustment is necessary at the looper L6-7 between mill stands F6 and F7. The microprocessor responds similarly to the width sensor 33 and the load cells 29.

Momentarily referring back to FIG. 2, each looper F(N), N+1) is intended to operate over a limited range of tensions as indicated by the dashed lines. In the range indicated in FIG. 2, there is approximately a linear relationship between tension and elongation. Therefore, for each looper, the ROM 58 contains an empirically determined relationship between change in tension and change in final gauge or width as illustrated by the table in FIG. 7.

In response to detection of a variation in gauge by gauge sensor 31, the microprocessor 50 looks to the table of FIG. 7 for the relationship between change in tension and change in gauge for the looper L6-7 between mill stands F6 and F7. From this linear relationship, the microprocessor 50 may quickly determine the proper amount of tension to be added or subtracted from the strip 17. By knowing the present position and torque of the looper arm 39, the present tension can be easily and quickly determined from the equations (1)–(6). By adding the change in tension to the present tension, the new tension setting for correcting the gauge variation is known. To achieve this new tension setting, the routines and subroutines of FIGS. 9–13 hold one of the two variables in equation (6) constant (either arm position or torque) and solve for the other variable. With the new torque or position determined, a command is issued to the sensors and controls unit 43 associated with the looper L6-7. Width adjustment in response to the width sensor 33 is accomplished in the same manner.

As for tension adjustments made in response to changes in the rolling forces sensed by the load cells 29 of mill stands F1 through F6, they are made in substantially the same manner as tension adjustments made in response to the gauge and width sensors 31 and 33, respectively. However, because the load cell system is intended for shorter wavelengths, the application of a change in tension is relatively fast, subject to the proper delay which ensures the gauge variation is positioned in a downstream plastic zone when the change in tension is applied. In the illustrated embodiment, the relative time constants or speeds of changes made to a looper's torque or position is handled by the microprocessor 50. Of course, as an alternative, analog devices could be used to ensure the proper response.

Normally, all of the control from the gauge sensor system is applied to the looper L6-7 between mill stands F6 and F7. When either the torque or position limits of looper L6-7 are reached, further commands from the gauge sensor system are delivered to loopers L4-5 and L5-6.

Operating parameters of the mill used to generate command signals are supplied from the torque and position sensors 60 and 62, respectively, of the loopers F(N), N+1), the speed sensors 64 for each mill stand F(N)) and the load cells 29 of the mill stands. All of these sensed operating parameters are used to ensure the system is adjusted correctly to provide the correct gauge and width as the strips leave the finishing mill. In FIG. 5, the various sensors are shown to be delivered to the bus 52 of the microprocessor system via a plurality of analog multiplexers 66*a–e* that serially feed the data from the sensors to an analog-to-digital (A/D) converter 68. The sampling frequency of the A/D converter 68 and the analog multiplexers 66 are synchronized by a control line 70 from the bus 52. From the A/D converter, the data is delivered to the microprocessor system for demultiplexing and processing by way of an input port 72.

To deliver commands to the sensors-and-controls units 43, an output port 80 passes control data from the bus 52 of the microprocessor system to one of four ports, depending upon whether the control signal is intended for a looper F(N), N+1), work rolls 23*a* and 23*b* or screwdown 27. To direct the command signal to the appropriate motor and associated mill stand F(N)), the signal includes an address which is decoded by one of address decoders 82*a–d*. Upon receiving an address, one of the address decoders 82*a–d* opens the appropriate gate 84*a–d* and the command signal passes to the motor of the correct mill stand F(N)).

From the gates 84*a–d*, the command signal goes to a latch 86 in the appropriate sensors-and-controls unit 43 shown in FIG. 6*a*. The data is held in the latch 86 and used to set an analog voltage for the appropriate one of the drives and motors 74, 76, 78 via one of digital-to-analog (D/A) converters 90*a–d*. In response to the command signal, the sensors of the sensors-and-controls unit 43 provide the microprocessor-based system with an updated indication of the operating parameters of the associated mill stand F(N)).

In keeping with the invention, the torque commands to the screwdowns 27 and the speed commands to the work rolls 23*a*, 23*b* of each mill stand are provided by the conventional mass flow control system. For the high tension control system of the invention, adjustment signals responsive to the gauge and width sensors 31 and 33, respectively, are delivered to a conventional signal summing device 93 by way of port three of output port 80, gate 84*c* and D/A converter 90*c*. For the shorter wavelength adjustments responsive to the load cells 29, they are combined at the summing device 93 with the longer wavelength adjustments of the gauge and width sensors 31 and 33, respectively. These shorter wavelength adjustments are delivered to the summing device 93 by way of port four of output port 80, gate 84*d* and D/A converter 90*d*. From the summing device 93, an analog control signal is delivered to the looper drive and motor 74 for adjusting the tension of the strip. As illustrated in FIG. 6*b*, the analog signal is a short wavelength correction signal superimposed over a longer wavelength correction signal. The longer wavelength is shown in dashed lines and is contributed by adjustment signals from gauge width sensors 31 or 33, depending upon which sensor is serving as a control input. The shorter wavelength adjustments are contributed by the signals from the load cell 29 of a mill stand F(N)).

Figure 13:
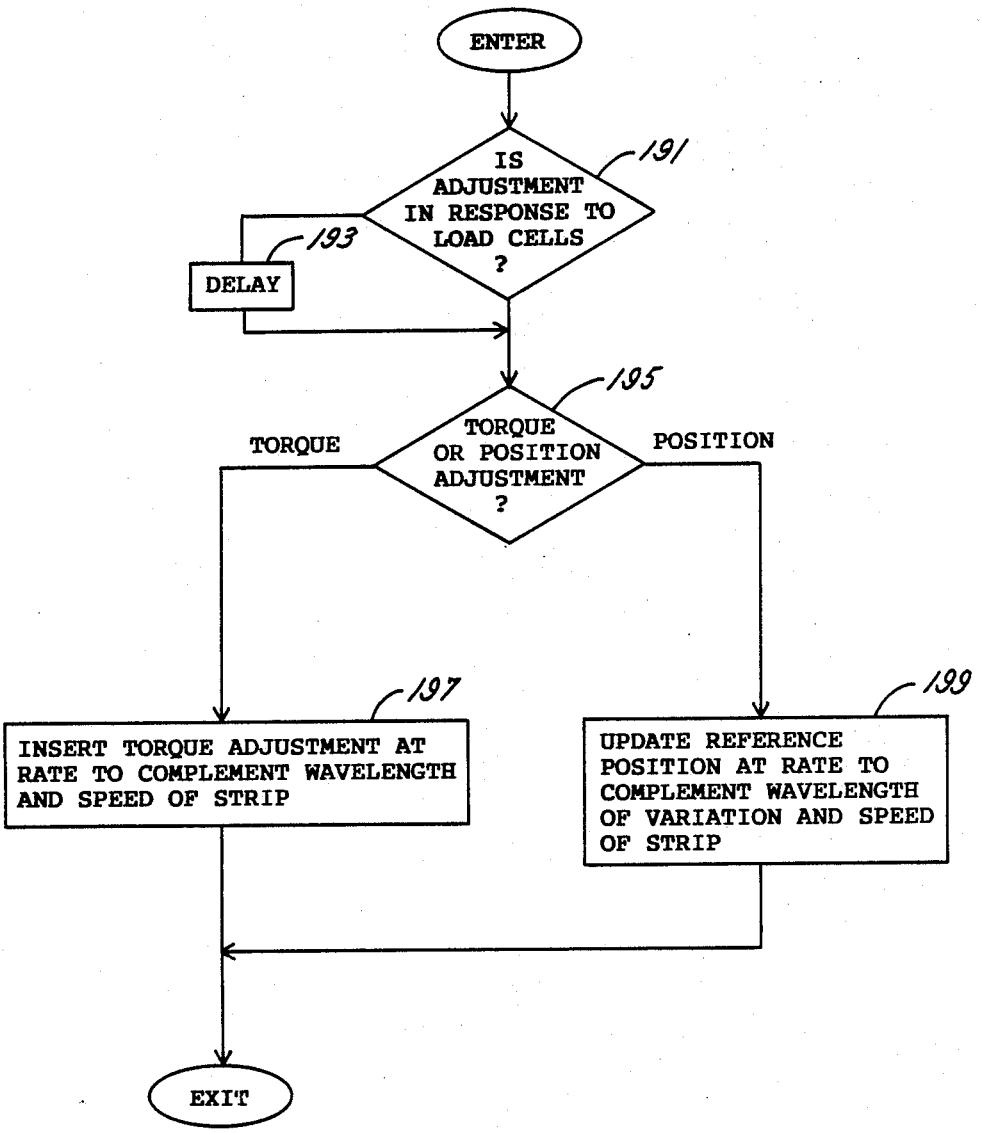
FIG. 13 is a flowchart of the software subroutine executed by each of the routines flowcharted in FIGS. 9*a*, 9*b*, 10 and 11 for executing the torque adjustment of the subroutine flowcharted in FIG. 12.

As will become clearer from the discussion of the Execute Adjustment Routine of FIG. 13, the waveform of FIG. 6*a* is illustrative of torque adjustment of a looper. Adjustments to the positions of the looper arm in order to adjust tension are accomplished by updating the reference positions maintained by the conventional mass flow control system.

As previously indicated, the high tension rolling of a steel strip inherently reduces gauge and width variations of shorter wavelengths. To further reduce these variations of shorter wavelengths and to also reduce dimensional deviations having longer wavelengths which are unaffected by static high tension rolling, the high tension control system of the invention is employed. To detect dimensional changes of longer wavelengths and make the appropriate tension changes in response thereto, the control system 36 includes the gauge and width routines set forth in the flowcharts of FIGS. 9*a–9b* and 11. In these routines, the control system 36 checks for trends in the gauge and width dimensions, i.e., variations of longer wavelengths. If a trend away from the desired gauge or width dimension is detected, the control system executes a tension adjustment in accordance with the software routines. For the shorter wavelength, the load cell routine of FIG. 10 is executed by the control system. To maintain stability, the gauge, width and load cell routines are complemented by the conventional mass flow control system. In this regard, the control system of the invention may be retrofitted to an existing mill without necessitating extensive redesign or removal of existing control systems.

Turning first to the Read Routine, gauge, width and load cell values are sampled and the most recent N samples are stored in the RAM 56 of the control system (See FIG. 5). The values of the N most recent samples from the gauge and width sensors 31 and 33 and the load cells 29 are used to determine whether the gauge and width of a strip include long or short wavelength variations. To collect the N samples, the microprocessor 50 executes the Read Routine which is stored in the ROM 54. In steps 101 and 103, the value of the gauge sensor 31 is sampled and stored with the values of the most recent N+1 samples. Similarly, in steps 105 and 107, the value of the width sensor 33 is sampled and stored with the values of the most recent N+1 samples. To complete the data collection at steps 109 and 111, the value of the load cell 29 at each mill stand F1–F6 is sampled and stored with the values of the most recent N+1 samples. The sampling and storing of data repeats at a frequency that ensures an adequate sensitivity to both short and long wavelength variations in gauge and width dimensions.

For gauge adjustment, the microprocessor 50 executes Gauge Sensor and Load Cell Routines as flowcharted in FIGS. 9 and 10, respectively. All of the routines executed by the microprocessor 50 are stored in the ROM 54. The Gauge Sensor and Load Cell Routines are responsive to the most recent N readings of the gauge sensor 31 and load cells 29 collected by the Read Routine in order to recognize short and long wavelength variations in gauge and execute the necessary adjustments to looper tension for effectively and substantially reducing the variations in the finished strip 17.

At start up of the control system, parameters such as the positions of screwdowns 27, speed settings for rollers 23*a*, 23*b* and looper arm positions are initialized by an Initialization Routine (not shown). The Initialization Routine is similar to prior initialization routines in that the loopers L1-2 through L6-7 are set for low tension. As a strip is threaded through the finishing mill, the loopers L1-2 through L6-7 are sequenced into high tension positions or torques. For example, as the head end of a strip travels between mill stand F1 and F2 and enters mill stand F2, the looper L1-2 maintains a low tension position or torque. After the head end has past through mill stand F2 and the strip area immediately following the head end experiences "neckdown", the position or torque of the looper L1-2 is changed so as to place the area of the strip spanning mill stand F1 and F2 under high tension.

Figure 9A:
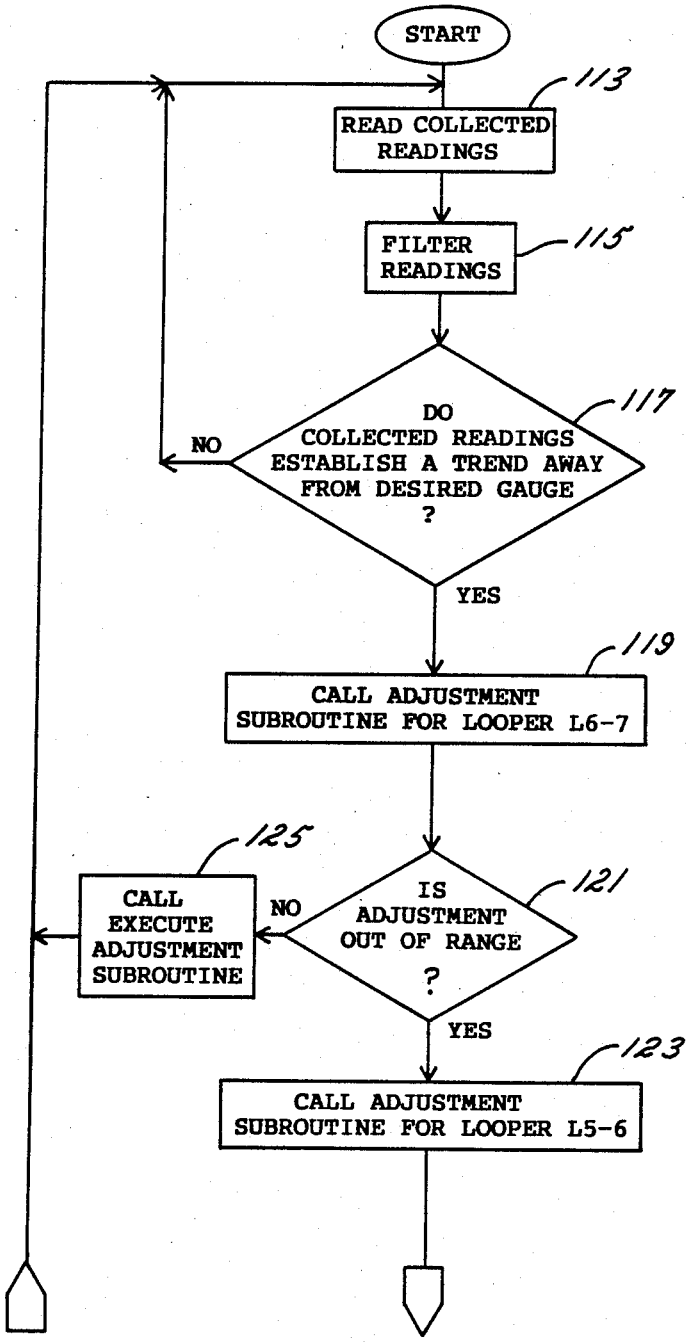
FIGS. 9*a* and 9*b* are a flowchart for the software routine executed by the microprocessor of the control system in FIG. 5 in order to adjust the gauge of steel strips in response to gauge changes at the output of the finishing stage.
Figure 9B:
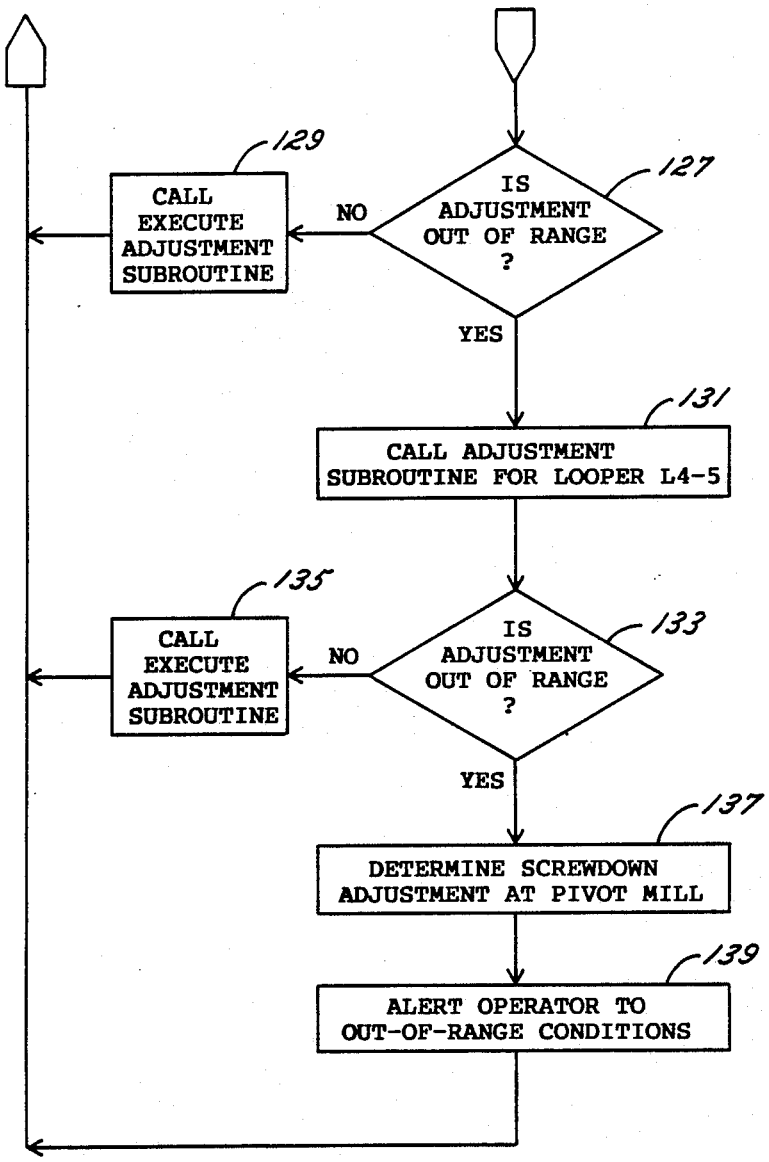
Figure 10:
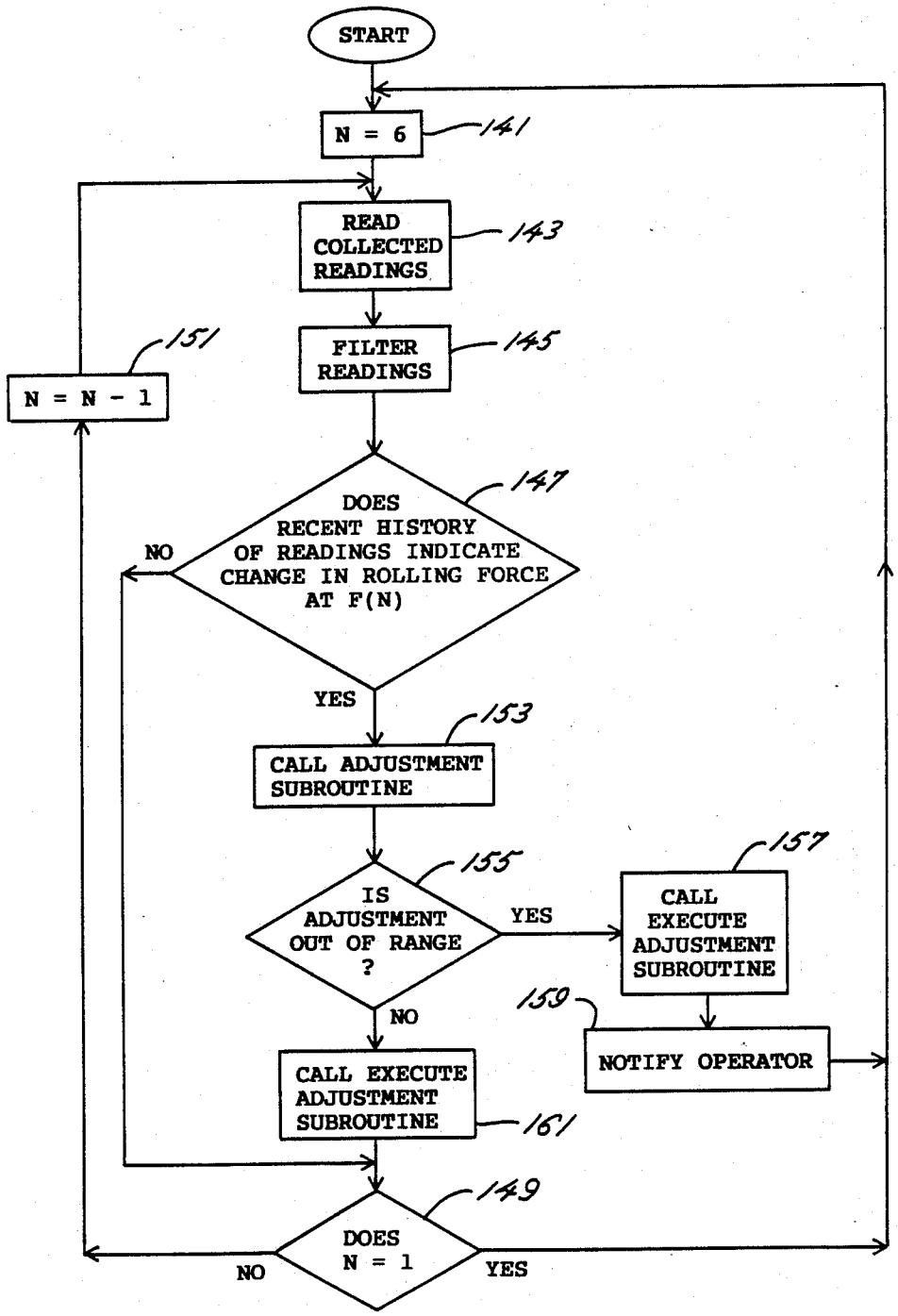
FIG. 10 is a flowchart for the software routine executed by the microprocessor of the control system in FIG. 5 in order to adjust the gauge of steel strips in response to changes in the rolling force of a mill stand in a manner which complements the adjustment of the gauge made by the routine flowcharted in FIGS. 9*a* and 9*b*.

After the head end of the strip has exited mill stand F7 and N readings of the gauge sensor 31 have been collected, the Gauge Sensor Routine of FIGS. 9*a*–9*b* reads the collected gauge readings at step 113 and, using well-known digital filtering and statistical techniques, determines at steps 115 and 117 if there is a long wavelength variation in the gauge. If a variation is not found, the Routine returns to step 113 and reads an updated N readings of gauge values.

If a long wavelength variation in the gauge is detected at steps 115 and 117, an Adjustment Subroutine (FIG. 12) is called at step 119 in order to determine the tension adjustment required at looper L6-7 to reduce the variation. Adding the torque or position adjustment determined in the Adjustment Subroutine to the present torque or position, step 121 determines if the adjustment places the looper L6-7 into an out-of-range position or torque. If neither position nor torque adjustment can be made without exceeding position or torque limits, the Routine moves to step 123 where the Adjustment Subroutine is executed for looper L5-6. If the Adjustment for looper L6-7 is not out of range, an Execute Adjustment Subroutine (FIG. 13) is called at step 125 in order to implement the adjustment. From step 125, the Routine returns to step 113 in order to read an updated N values of gauge from the gauge sensor 31.

In executing the Adjustment Subroutine at step 123 for looper L5-6, it is assumed that looper L6-7 will be adjusted to its torque or position limit and the remaining required adjustment will be provided by looper L5-6. For example, if the error in gauge to be corrected is −0.001 inches and the in-range torque or position adjustment of looper L6-7 will only provide correction of +0.0005 inches, the Adjustment Subroutine is executed for looper L5-6 in step 123 using a gauge error value of the difference between the total error and the in-range correction given by looper L6-7—i.e., −0.0005 inches.

As with the adjustment for looper L6-7, the adjustment calculated for L5-6 is added to the present torque or position of the looper at step _in order to determine if the adjustment creates an out-of-range condition. If the adjustment does not cause an out-of-range condition, the Execute Adjustment Subroutine is called at step 129 for adjusting loopers L6-7 and L5-6.

Continuing with the adjustment example of −0.001 inches of gauge, if the looper F5-6 cannot provide an in-range torque or position adjustment for the full 0.0005 inches, the Routine branches to step 131 where the Adjustment Subroutine is executed for looper L4-5, using a gauge error value equal to the total error (i.e.,0.001 inches) minus the in-range corrections provided by loopers L6-7 and L5-6.

As with the adjustments of loopers L6-7 and L5-6, the adjustment determined for looper L4-5 is added to the present torque or position of the looper at step 133 in order to determine if the adjustment is out of range. If the adjustment is entirely in range, the Routine steps to step 135 where the Execute Adjustment Subroutine of FIG. 13 is executed for all three loopers L6-7, L5-6 and L4-5.

If the full adjustment for looper L4-5 is out of range, the Routine branches to step 137 where a rolling force adjustment for the next-to-last mill stand F6 is determined. In the conventional mass flow control system of control system 36 in FIG. 1, the mill stand F6 acts as a "pivot" in that a rolling force change at mill stand F6 results in the adjustment of the rolling force of the other mill stands in order to equalize mass flow. So that the mill operator is aware of the out-of-range condition of the gauge control loopers, step 139 provides for activation of the display panel 140 (see FIG. 5).

Referring to the flowchart for the Load Cell Gauge Adjustment Routine of FIG. 10, each of the mill stands F1-F6 is sequentially adjusted by the routine in response to changes in the rolling force sensed by the load cell 29 of the mill stand F(N)). In the illustrated embodiment, the high tension adjustment in response to the load cells 29 is carried out utilizing a digital scheme. Specifically, the changes in rolling force at a mill stand F(N)) are digitized and passed through a high-pass digital filter in order to ensure that the Load Cell Gauge Adjustment Routine responds to shorter and medium wavelength variations only. The high tension control in response to the load cells 27 of a mill stand F(N)) can alternatively be accomplished with an analog gauge error signal which is passed through an analog high-pass filter. The filtered error signal may then be converted to a tension signal, a time delay is added and then the delayed tension signal is applied to the appropriate looper F(N), N+1).

In a digital implementation of the Load Cell Gauge Adjustment Routine, the number of mill stands F(N)) incorporated into the system is set at step 141. In the illustrated embodiment, the Load Cell Gauge Adjustment Routine includes mill stands F1–F6. As a possible alternative, only loopers responsive to the gauge sensor 31 may be made responsive to the load cells 27 of their upstream mill stands F(N))—e.g., mill stands F4–F6 in the illustrated embodiment.

Figure 8:
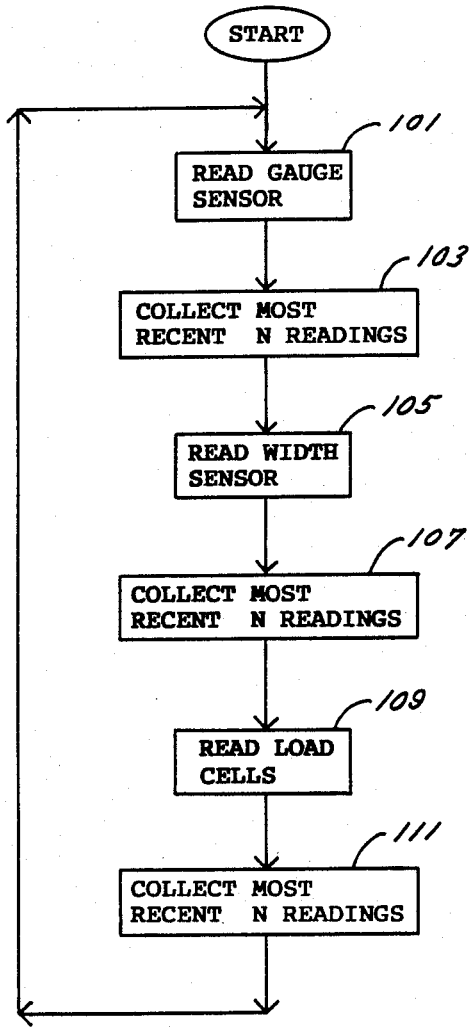
FIG. 8 is a flowchart for the software Read Routine executed by the microprocessor of the control system in FIG. 5 in order to read the gauge and width of the strips.

From step 141, the Load Cell Gauge Adjustment Routine reads collected load cell readings from the Read Routine flowcharted in FIG. 8 as indicated by step 143. In step 145, the collected load cell readings are passed through a digital high-pass filter in order to ensure that the tension adjustment is responsive to shorter and medium wavelength gauge variations. With the readings appropriately filtered, they are analyzed at step 147 to determine if a gauge variation requiring correction is present. As with the gauge variation determination made in the Gauge Sensor Routine flowcharted in FIGS. *9a–9b*, a gauge variation in step 147 can be determined by well-known statistical techniques.

If a variation in gauge is not found at step 147, the flowchart jumps to step 149 which determines if the last mill stand F(N)) in the sequence (i.e., F1) has been serviced. If the present mill stand F(N)) under adjustment is not mill stand F1, the flowchart increments the value N at step 151 and returns to step 143 in order to read collected load cell values for the next mill stand F(N)). On the other hand, if the current mill stand F(N)) is mill stand F1, the flowchart returns to step 141 from step 149 where the number "N" is reset to six so that the next mill stand F(N)) is F6.

Figure 12:
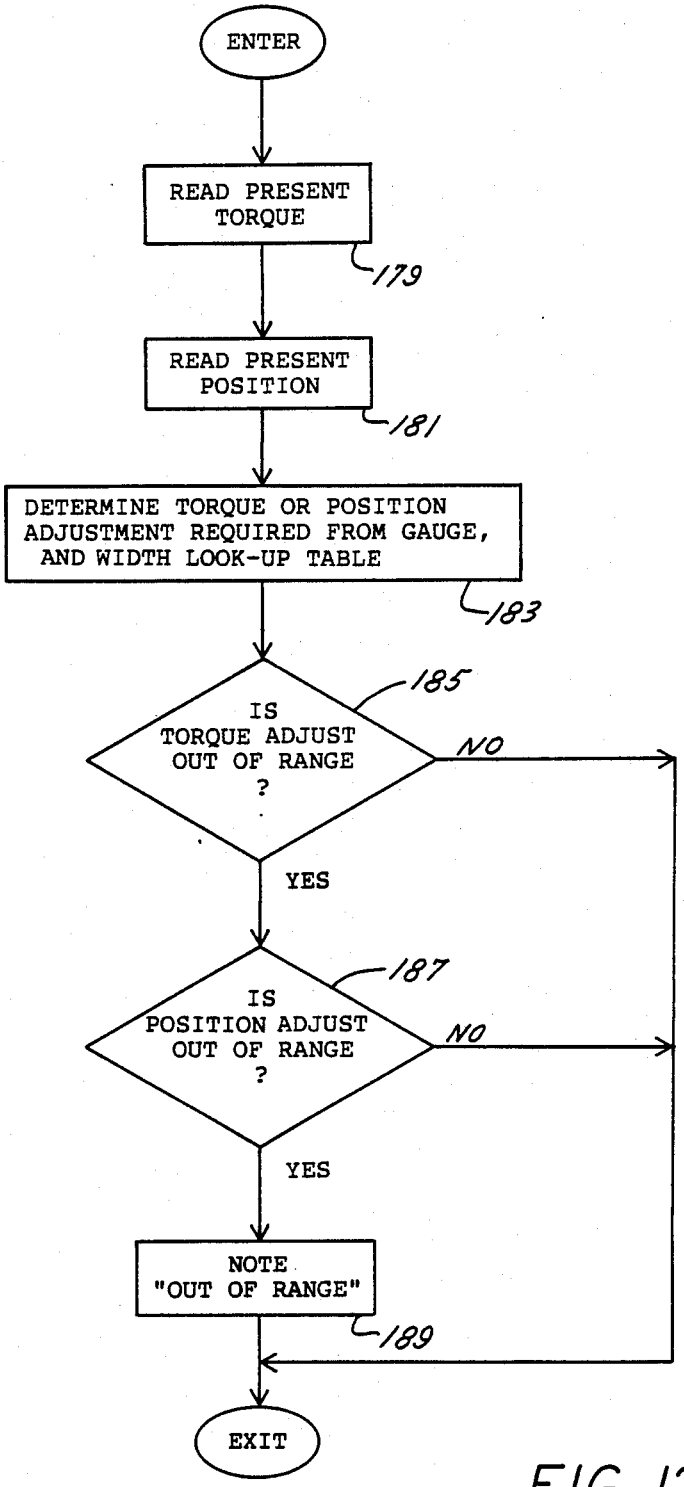
FIG. 12 is a flowchart of a subroutine executed by each of the routines flowcharted in FIGS. 9*a*, 9*b*, 10 and 11 for determining the torque or position adjustment of a looper roll required in order to provide the needed gauge or width adjustment.

If it is determined at step 147 that a variation in the rolling force has occurred at mill stand F(N)), the flowchart branches to step 153 where the Adjustment Subroutine of FIG. 12 is executed. With the new torque or position value known for the adjacent downstream looper F(N), N+1), the flowchart determines whether the adjustment is out of range at step 155. If the adjustment is out of range, the flowchart branches to step 157 where the Execute Adjustment Subroutine is called to make the position or torque adjustment to the extent that it is in range. At step 159, the operator is notified of the incomplete adjustment by, for example, activating a light on the control panel 140. If the adjustment calculated in step 153 is entirely in range, the flowchart branches to step 161 where the adjustment is executed by the Execute Adjustment Subroutine.

Figure 11:
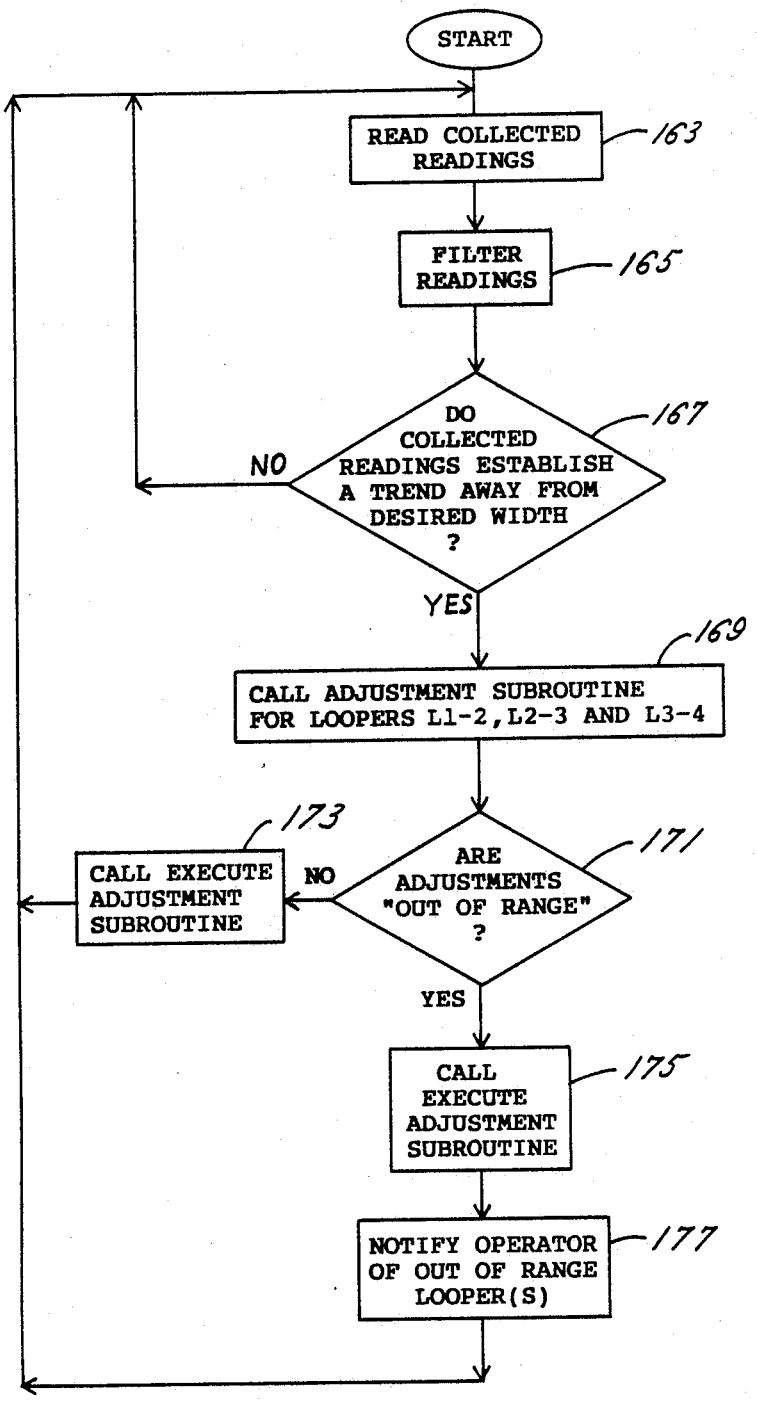
FIG. 11 is a flowchart for the software routine executed by the microprocessor of the control system in FIG. 5 in order to adjust the width of steel strips in accordance with the invention.

For width adjustment in response to the width sensor 33, the Width Adjustment Routine flowcharted in FIG. 11 first reads collected width data from the width sensor 33 as collected by the Read Routine of FIG. 8. After reading the collected width readings at step 163 in FIG. 11, the width adjustment flowchart moves to steps 165 and 167 where the readings are filtered and analyzed to determine whether there is a long wavelength variation of width. As with the collected gauge readings from the gauge sensor 31 in FIGS. *9a–9b*, the determination of a long wavelength variation is accomplished utilizing well-known statistical techniques. If a long wavelength variation in width is not detected at step 167, the flowchart returns to the step 163 in order to read a new collection of width readings from the width sensor 33. If a variation in width is detected at step 167, however, the flowchart branches to step 169 where the Adjustment Subroutine of FIG. 12 is called for the loopers L1-2, L2-3 and L3-4. With the adjustment calculated, the Width Adjustment Routine determines at step 171 whether the adjustment places either the torque or position of the associated looper out of range. If the torque or position is not out of range, the flowchart branches to step 173 where the Execute Adjustment Subroutine is called. If the adjustment is found at step 171 to render the torque or position of the associated looper out of range, the flowchart branches from step 171 to step 175 where the in-range portion of the adjustment is executed. From step 175, the flowchart alerts the operator at step 177 that a complete adjustment is out of range.

Turning to the Adjustment Subroutine called by the gauge, width and load cell routines of FIGS. 9–11, the routine first reads the present torque and position of a particular looper at steps 179 and 181, respectively. Knowing the change in gauge or width required, the look-up table of FIG. 7 is referenced in step 183 in order to determine the necessary change in tension to accomplish the required adjustment. With the new tension known, equation (6) may be used to solve for a new torque value, holding the reference position of the looper constant. Also, a new reference position for the looper is determined by solving equation (6), holding the torque F constant.

In determining the necessary torque or position adjustment, the gauge/tension relationship of FIG. 7 is used whenever the Adjustment Subroutine is called by the Gauge and Load Cell Routines of FIGS. 9 and 10. The width/tension relationship of FIG. 7 provides the basis for calculating a width adjustment from the Width Routine of FIG. 11.

Returning to FIG. 12, after the appropriate tension adjustment is determined in step 183, the flowchart then determines whether the new value of the torque F is an out-of-range value at step 185. If it is not out of range, the Subroutine exits back to the main routine (e.g., gauge or width sensor or load cell). If the new torque F value is out of range, however, the flowchart branches to step 187 where the new position value is examined. If the new position is also out of range, the flowchart branches to step 189 where an "out-of-range" condition for the looper is recorded.

If both the torque and position adjustments for a looper are out of range, it is contemplated that the in-range adjustment executed by the main routines is the adjustment which provides the greatest percentage adjustment of the desired tension change.

In order to implement a change in torque, the energy supplied to the looper motor 45 is modified. The relationship between input energy and output torque for the looper motors is well known. When a position adjustment results from the adjustment subroutine of FIG. 12, the reference positions of the looper arms are changed. When the high tension control system changes the reference position of a looper, the standard mass control system then attempts to adjust the mass flow to hold the looper at its new updated reference position.

In order to avoid the introduction of short or medium wavelength variations by the too-fast implementation of a change in reference position for a looper in response to the Gauge or Width Routines, the change is preferably done gradually, thereby ensuring mass flow remains substantially stable. Because the change in position is implemented in a digital manner in the illustrated embodiment, the gradual change in the reference position for a looper is executed in quantum steps. The quantum steps are made sufficiently small so that any instantaneous change in mass flow is not reflected in a significant dimensional change at the output of mill stand F7. For the Load Cell Routine, a position adjustment must be made quickly in keeping with the shorter wavelength nature of the gauge variation. Because the position change must be relatively fast, it is made either at larger increments then are position adjustments for the Gauge and Width Routines or the increments are the same size, but they are added to the reference position at a significantly higher rate.

Referring to the flowchart of the Execute Subroutine in FIG. 13, the updating of tension applied by a looper begins at step 191 by firs determining whether the tension adjustment is in response to the Load Cell Routine. An appropriate delay is inserted into the adjustment at step 193 if the adjustment is for the Load Cell Routine.

Otherwise, the Subroutine proceeds to step 195 where the flowchart branches to either step 197 or 199, depending upon whether the adjustment is to torque or position. In step 197, the torque adjustment of looper motor 45 is made at a rate which complements the wavelength of the variation the adjustment is intended to correct. In step 199, the position adjustment is made at a rate which also complements the wavelength of the variation.

From the foregoing, it will be appreciated that a new and improved dimensional control system for hot rolling mills is described which provides width control which was heretofore unknown and improved gauge control, which has response times and dimensional control that are significantly better than prior art systems. Because the inertia mass of the looper arms is significantly less than the work rolls of the mill stands F(N)), adjustments to tension on a strip can be made relatively quickly. This quick response time provides a control system which not only improves dimensional variations having longer wavelengths, but also dimensional variations of shorter wavelengths which require relatively fast response times for effective correction. The high tension control system of the invention may be implemented in existing mills merely by supplementing an existing control system for controlling looper position. In most modern mills, gauge and width sensors and load cells for measuring rolling forces are already in place. Therefore, the invention may be easily retrofited to an existing mill with minimum inconvenience and expense.

I claim:

1. In a finishing stage of a hot rolling mill, an apparatus for approximating monotonic dimensions along the lengths of strips formed by said hot rolling mill, said apparatus comprising:

a plurality of cooperating mill stands in said finishing stage for receiving said strips, where the distance separating any two adjacent mill stands is less than the length of one of said strips;

a sensor assembly including a first sensor for sensing a gauge dimension of said strips and a second sensor for sensing a width dimension of said strips;

a tension device located between at least one pair of adjacent mill stands for adding tension to said one of said strips as it is simultaneously worked by both mill stands in said pair of adjacent mill stands, where said added tension results in a force that causes said one of said strips to stretch beyond its elastic limit, resulting in a reduction in value of at least one of the gauge and width dimensions of said one of said strips; and means responsive to said sensor assembly for controlling the amount of tension added to said strip by said tension device so as to direct said at least one of the gauge and width dimensions of said one of said strips toward a predetermined value.

2. An apparatus as set forth in claim 1 wherein said tension device comprises a plurality of looper rolls, each positioned between adjacent mill stands, said plurality of looper rolls divided into upstream and downstream groups, said means responsive to said first and second sensors for controlling tension applied to said strips by said downstream and upstream groups of loopers, respectively.

3. An apparatus as set forth in claim 2 wherein said means is a microprocessor-based control system which includes a means for maintaining equal mass flow through all said mill stands.

4. An apparatus as set forth in claim 2 wherein said sensor assembly includes a third sensor for sensing a gauge dimension of said strips and said means responsive to said third sensor for controlling tension applied to said strips by at least said downstream group of loopers in a manner to complement the tension control provided by said first sensor.

5. In a finishing stage of a rolling mill having a plurality of mill stands, a method for approximating monotonic dimensions along the length of the strips formed in said rolling mill, said method comprising the steps of:

threading one of said strips through said plurality of mill stands where said strip is at least sufficiently long to bridge adjacent mill stands;

placing tensions on mill areas of said strip bridging said adjacent stands such that said strip is stretched beyond its elastic limits, thereby permanently effecting the value of the gauge and width dimensions of said strip;

finding the difference between at least one of said gauge and width dimensions of said strip and a predetermined value; and controlling the tension on said areas of said strip between a group of said plurality of mill stands in order to minimize said difference and provide an approximate monotonic value of at least one dimension of the strip along the entire length of the strip.

6. A method as set forth in claim 5 wherein the step of controlling tension includes:

controlling the tension on said areas of said strip between an upstream group of said plurality of mill stands in order to provide an approximate monotonic value of width from head to tail ends of said strip.

7. A method as set forth in claim 6 wherein the step of controlling tension includes:

controlling the tension on said areas of said strip between a downstream group of said plurality of mill stands in order to provide an approximate monotonic value of gauge from head to tail ends of said strip.

8. A method as set forth in claim 5 including the step of:

equalizing mass flow through said finishing stage in response to a change in tension on any of said areas.

9. An apparatus for approximating monotonic dimensions along the length of strips being processed by a finishing stage of a hot rolling mill, said apparatus comprising:

first means for applying tension to said strips so that they are stretched beyond their elastic limit, thereby changing the width and gauge dimensions of said strips;

second means for measuring said width and gauge dimensions of said strips, located downstream from said first means; and third means responsive to said second means for controlling the amount of tension applied by said first means such that the width and gauge dimensions are approximated to a predetermined value.

10. An apparatus as set forth in claim 9 wherein said first means includes first and second in-line devices such that said second device applies tension to a downstream region of one of said strips independently of tension supplied by said first device to an upstream region of one of said strips and said third means includes (1) a first controller responsive to a measurement of width from said second means for controlling the tension applied by said first device and (2) a second controller responsive to a measurement of gauge from said second means for controlling the tension applied by said second device.

11. An apparatus as set forth in claim 9 wherein said first and second in-line devices are a plurality of looper rolls with each of said looper rolls positioned between adjacent mill stands comprising said finishing stage.

12. An apparatus as set forth in claim 9 including:

fourth means responsive to said first means for detecting changes in the tension of said strip and maintaining equal mass flow through each mill stand comprising said finishing stage.

* * * * *